US007008252B2

(12) United States Patent
Wu et al.

(10) Patent No.: US 7,008,252 B2
(45) Date of Patent: Mar. 7, 2006

(54) TERMINAL STRUCTURE OF A SOCKET

(75) Inventors: Chang-Ta Wu, Bansiao (TW); Chun-Chieh Wang, Jhonghe (TW)

(73) Assignee: Micro-Star Int'l Co., Ltd., Taipei (TW)

( * ) Notice: Subject to any disclaimer, the term of this patent is extended or adjusted under 35 U.S.C. 154(b) by 0 days.

(21) Appl. No.: 10/867,104

(22) Filed: Jun. 14, 2004

(65) Prior Publication Data

US 2005/0020119 A1 Jan. 27, 2005

(30) Foreign Application Priority Data

Jun. 20, 2003 (TW) ..... 92211344 U

(51) Int. Cl.
*H01R 4/50* (2006.01)

(52) U.S. Cl. ..... 439/342

(58) Field of Classification Search ..... 439/342, 439/259

See application file for complete search history.

(56) References Cited

U.S. PATENT DOCUMENTS 4,331,371 A * 5/1982 Ichimura et al. ..... 439/269.1
5,057,031 A * 10/1991 Sinclair ..... 439/261
5,370,549 A * 12/1994 Lee ..... 439/261
5,989,049 A * 11/1999 Walkup et al. ..... 439/342
6,461,182 B1 * 10/2002 Hsu ..... 439/342

* cited by examiner

*Primary Examiner*—Neil Abrams
(74) *Attorney, Agent, or Firm*—Apex Juris, pllc; Tracy M Heims

(57) ABSTRACT

A terminal structure of a socket has two abutting contact surfaces on a terminal to form an acute angle to become a guiding mechanism to couple and contact with a pin of a chip easier and more accurately, and reduce faulty coupling of the pin and prevent the pin and terminal from deformation, fracturing or defective contact caused by tilting of the pin during insertion. The terminal structure of a socket may be applied on SMT and DIP applications, and is adaptable to pin slots of various shapes, and provide improved common sharing capability and applicability, and may be fabricated at a lower cost.

2 Claims, 4 Drawing Sheets

TERMINAL STRUCTURE OF A SOCKET

FIELD OF THE INVENTION

The present invention relates to a terminal structure of a socket for coupling pins of a chip and particularly to a simplified terminal design that has a V-shape cross section.

BACKGROUND OF THE INVENTION

For mounting a chip with a lot of pins such as a central processing unit (CPU) onto a circuit board, the general approach is to mount a socket with many pin slots onto the circuit board. Each pin slot has a conductive terminal coupling with the circuit board. The pins of the chip are inserted into the pin slots to be in contact with the terminals, to establish electric connection. However, merely having the pins inserted into the pin slots not necessary means that the pins and the terminals have formed a desired electric connection.

The terminal structure often determines whether a contact is good or poor. In general, especially for a CPU, the socket is covered by a sliding cap which has many through holes formed thereon. The sliding cap may be moved horizontally by a swinging control arm to position at a selected location. The pins of the chip have to be inserted into the through holes first, then are inserted into the pin slots of the socket. The horizontal movement of the sliding cap moves the pins close to the terminals so that the contact of the two is tight and secured to reduce defective connection. While such a design can reduce some defective contacts, the pins still might be tilted during insertion or horizontal movement and result in deformation or fracture of the pins or terminals. As a result, defective contact and connection still occurs.

As previously discussed, the key issue of the problems is the terminal structure. The present terminal generally is formed in U-shape or a variation under the same structure. A good contact between the pin and the terminal basically depends on the elasticity of the terminal structure. Due to a lack of suitable guiding means for insertion, or the structural problem, the possibility of a tilted pin to cause deformation or defective contact of the terminal is high. Moreover, the present terminal structure has to mate the pin slot. Hence product expandability and applicability is limited. Elements thus made cannot be commonly shared. As a result, they are not suitable for mass production and the cost is higher.

SUMMARY OF THE INVENTION

The objection of present invention is to resolve the problems of the conventional terminal structure, such as deformation or fracture of pins and terminals and defective contact caused by insertion of the tilted pins.

In view of the aforesaid problems, the invention provides a terminal structure of a socket that includes a plurality of terminals located in the pin slots of the socket that are in contact with a plurality of pins of a chip. Each terminal has a V-shape cross-section to enable the lateral sides of the pin to be in contact with the V-shape inner sides of the terminal.

By means of the structure of the invention, the inner sides of the V-shape terminal form a guiding mechanism and can reduce faulty coupling of the chip pins and prevent the pins or terminals from fracturing or forming defective contact caused by insertion of tilted pins. It not only is adaptable for socket pin slots of various shapes, also significantly improves product sharing capability and applicability, and is adaptable for surface mount technology (SMT) and DIP applications.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
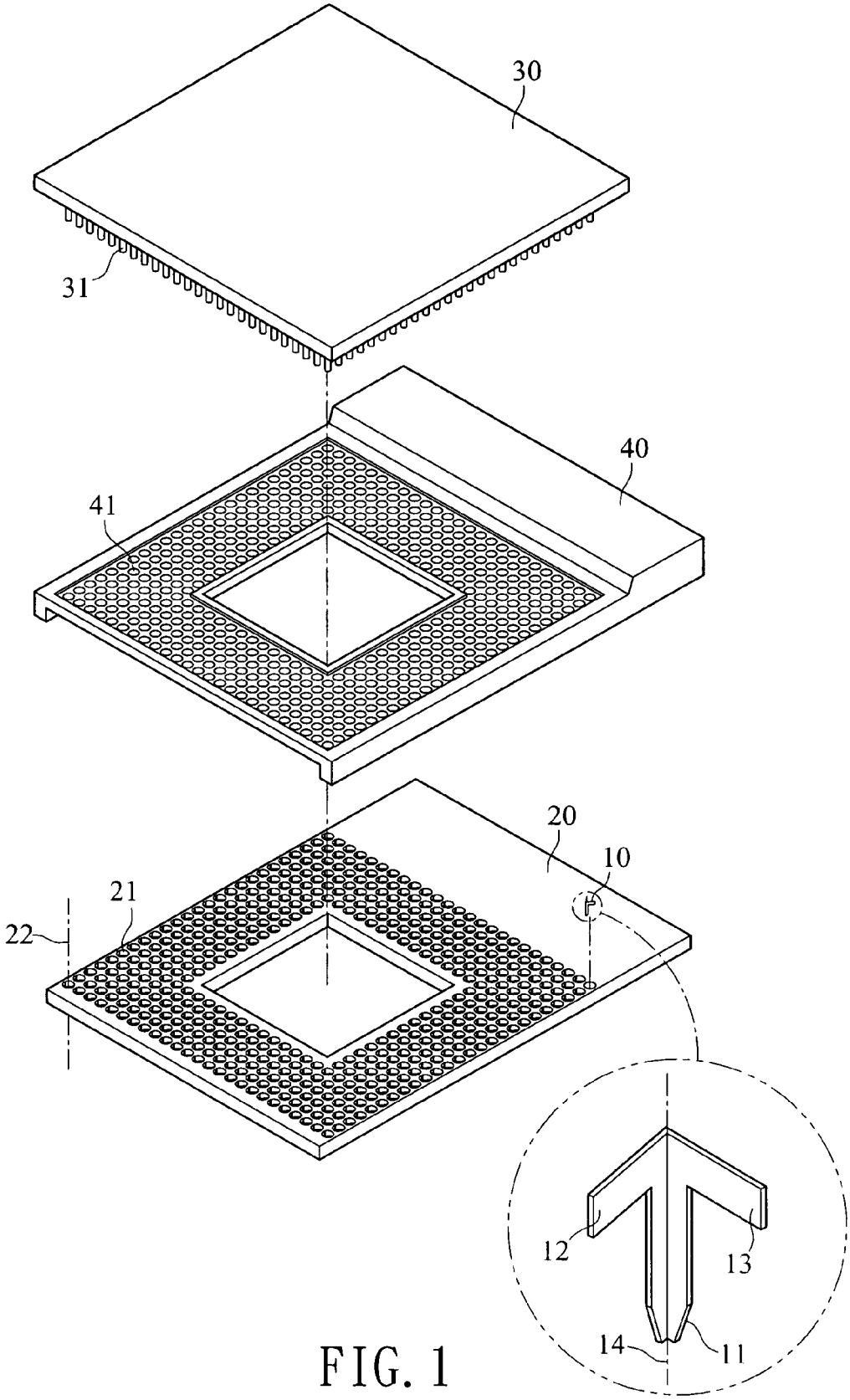
FIG. 1 is an exploded view of a first embodiment of the invention.
Figure 2:
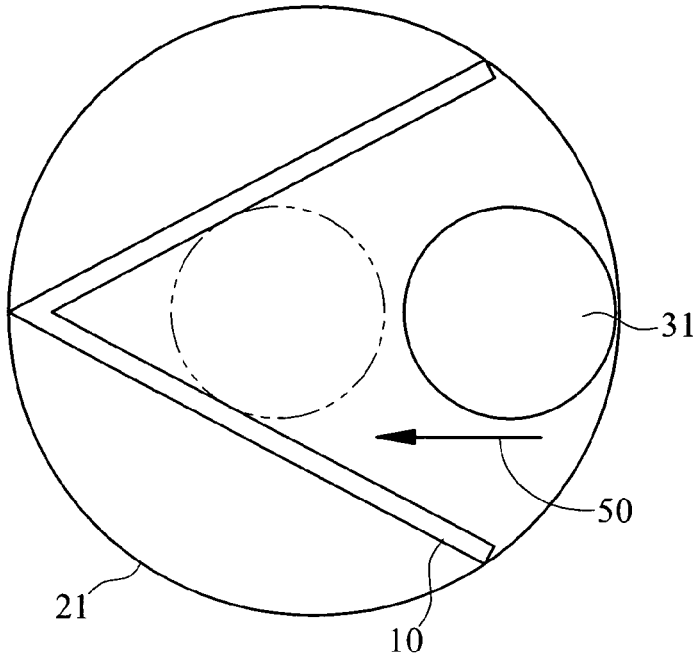
FIG. 2 is a top view of the first embodiment of the invention in use.

Refer to FIGS. 1 and 2 for a first embodiment of the invention. The terminal 10 according to the invention is inserted into a circular pin slot 21 formed on a socket 20 through a DIP method, then is soldered on the socket. The socket 20 is mounted onto a circuit board (such as the host main board, not shown in the drawings). After it has been soldered, the terminal forms electric connection with the circuit board, to connect to other elements on the circuit board.

The terminal 10 is formed by bending a T-shape blade, which is a conductor with desired electric characteristics. It has two abutting contact surfaces, forming an acute angle, and two wing ends 12 and 13, extended horizontally to two sides of the top end. It has a bottom end shaped in a tapered manner to form a narrow conical end 11. In normal conditions, the longitudinal bending line 14 of the terminal 10 is substantially in parallel with the long axis 22 of the pin slot 21. Such a structure helps the pin 31 of the chip 30 (such as CPU) to have effective contact (will be elaborated later) and prevents the pin 31 from tilting during insertion.

To establish contact between the terminal 10 and the pin 31 of the chip 30, first, have the pin 31 running through a through hole 41 of a sliding cap 40 above the socket 20; then insert the pin into the pin slot 21 of the socket 20 as shown in FIG. 1.

Referring to FIG. 2, after the terminal 10 that has a V-shape cross section is housed in the circular pin slot 21, a housing space is formed that gradually shrinks towards the bending line 14. When the pin 31 is inserted into the pin slot 21, the selected location of the insertion is spaced from the terminal 10 at a greater distance and has a greater allowance. The horizontal movement of the sliding cap 40 (usually moved by swinging of a control arm, not shown in the drawings) can move the chip 30 and every pin 31 in the direction of the arrow 50. Finally every pin 31 has its lateral side in contact closely with the V-shaped inner surfaces of the terminal 10. The design of the shrinking contact surfaces provides a guiding mechanism to prevent the pin 31 from being tilted, and the terminal 10 or the pin 31 from being deformed and fractured during insertion or a horizontal movement process.

As the blade type terminal 10 has elasticity (characteristics of a metallic blade), the sliding cap 40 is moved at a greater distance to allow the pin 31 and terminal 10 to form a close contact and tight coupling. The reason of having the bending line 14 of the terminal 10 substantially in parallel with the long axis 22 of the pin slot 21 is to make the long axis of the pin 31 also in parallel with the long axis 22 of the pin slot 21, while the pin 31 is inserted into the pin slot 21, so that the pin 31 and the inner surfaces of the terminal 10 can form a close contact.

In short, the terminal of the invention has a V-shape structure to guide the pin to form a close contact so that even if the pin tilts. It still has a greater chance to form a desired contact with the V-shaped contact surfaces of the terminal. Thereby the problems of deformation and fracture or defective contact of the conventional structure are solved.

Figure 3:
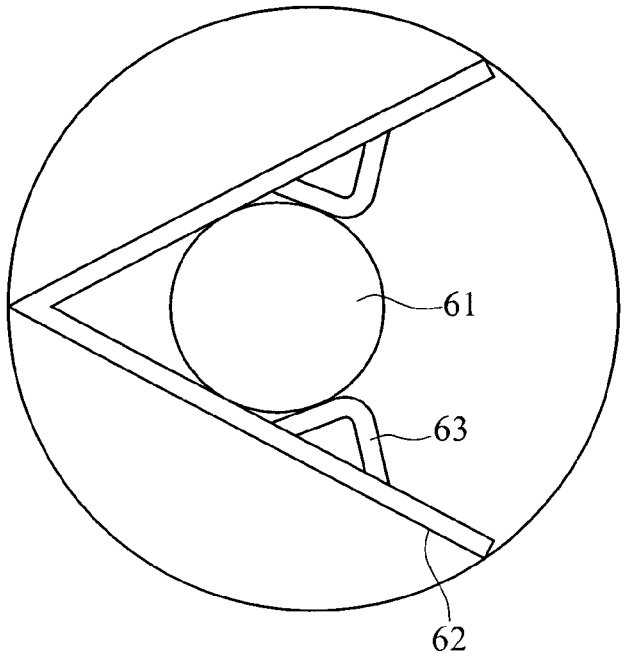
FIG. 3 is a top view of a second embodiment of the invention in use.
Figure 4A:
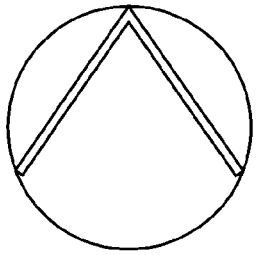
FIGS. 4A through 4E are top views of the terminal of the invention coupling with pin slots of various shapes.
Figure 4B:
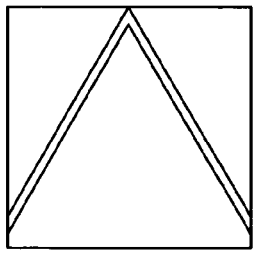
Figure 4C:
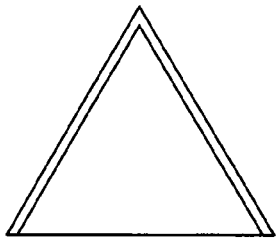
Figure 4D:
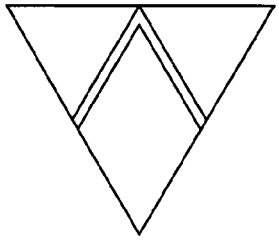
Figure 4E:
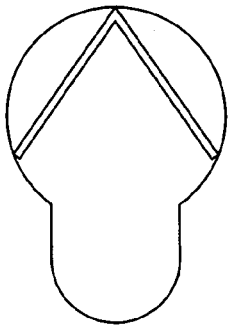

Refer to FIG. 3 for a second embodiment of the invention. In order to increase the contact area between a pin 61 and a terminal 62, and increase the coupling strength, the inner surface of the terminal 62 has jutting humps 63 to jointly clamp the pin 61 with the V-shaped inner surface of the terminal 62.

Figure 5:
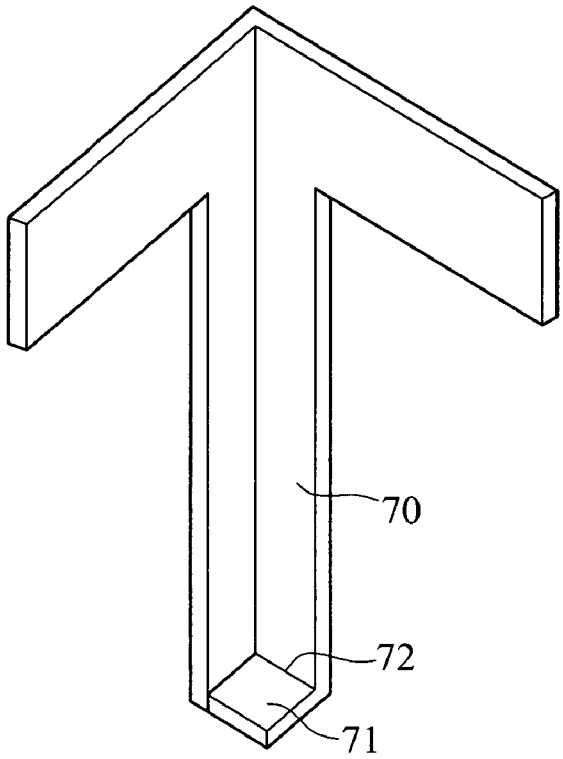
FIG. 5 is a perspective view of a third embodiment of the invention.

The V-shaped cross section of the terminal of the invention is adaptable to various shapes of pin slots. FIGS. 4A through 4E show a few of them that include a circular, square, triangle or keyhole shape. Hence the products of the invention have a greater sharing capability and applicability. Moreover, in addition to the two inner contact surfaces formed by the V-shaped terminal, the invention also provides a technique to increase the contact surface. Refer to FIG. 5 for a third embodiment of the invention. The bottom of the terminal 70 is bent upwards to form a bucking section 71. Therefore, the inner V-shaped surface of the terminal has three abutting contact surfaces to provide an additional contact surface for the pin (not shown in the drawings).

In case the pin hits the bucking section 71 during horizontal movement and tilt, the edges of the bucking section 71 are lower than the bending portion 72.

Figure 6:
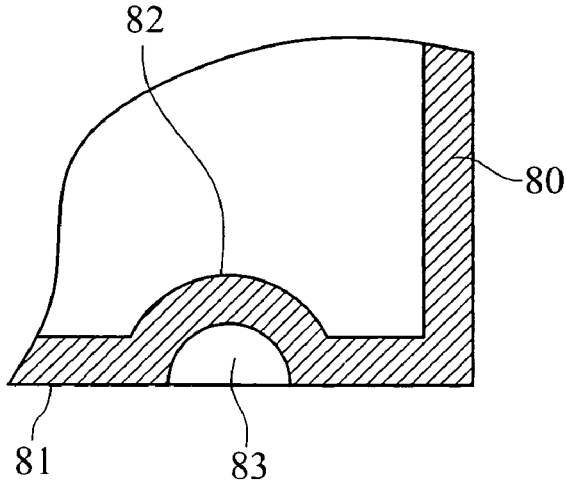
FIG. 6 is a fragmentary cross section of a fourth embodiment of the invention.

Another approach may be adopted as shown in FIG. 6, which illustrates a fourth embodiment of the invention. The bucking section 81 at the bottom of the terminal 80 has a bulged section 82, directing upwards, formed by stamping. The bulged section 82 is in contact with the bottom of the pin (not shown in the drawing). This overcomes the concern of tilting the pin during horizontal movement. This embodiment and its variations in shape are adopted for SMT for soldering the terminal in the pin slot of the socket. The lower side of the bulged section 82 forms a recess 83 for holding a tin ball during the soldering process. In addition, the terminal with the bucking section also is more desirable for the terminal with a conical end and more suitable for adopting SMT.

It is to be noted that although bending a T-shape body forms the terminals in the disclosed embodiments, a rectangular blade may also be bent and used as long as the function of the terminal is not affected.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A terminal structure of a socket coupling and in contact with a plurality of pins of a chip, comprising:

a plurality of terminals located in a plurality of pin slots of the socket, each of the terminals having two abutting contact surfaces forming an acute angle, each pin having lateral sides in contact with the contact surfaces of the terminal, the terminal has at least a jutting hump formed on a desired location of an inner side thereof to engage with the contact surfaces of the terminal to hold the pin and to increase the contact area and coupling strength.

2. A terminal structure of a socket comprising a socket, a plurality of pin slots formed on the socket and a plurality of terminals located in the pin slots coupling and in contact with a plurality of pins of a chip, wherein:

each of the terminals has two abutting contact surfaces forming an acute angle, each pin having lateral sides in contact with the contact surfaces of the terminal, the terminal has at least a jutting hump formed on a desired location of an inner side thereof to engage with the contact surfaces of the terminal to hold the pin and to increase the contact area and coupling strength.

* * * * *